US007409737B2

(12) United States Patent
Cho et al.

(10) Patent No.: US 7,409,737 B2
(45) **Date of Patent: *Aug. 12, 2008**

(54) APPARATUS AND METHOD FOR DETECTING MALFUNCTION OF A CLUTCH OF WASHING MACHINE

(75) Inventors: In Haeng Cho, Changwon-shi (KR); Jae Cheol Lyu, Changwon-shi (KR); Bon Kwon Koo, Seoul (KR); Kwon Ki Hong, Changwon-shi (KR); Min Jin Oh, Changwon-shi (KR); Du Heig Choi, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 538 days.

This patent is subject to a terminal disclaimer.

(21) Appl. No.: 10/486,100

(22) PCT Filed: May 16, 2003

(86) PCT No.: PCT/KR03/00971

§ 371 (c)(1),
(2), (4) Date: Aug. 24, 2004

(87) PCT Pub. No.: WO03/097921

PCT Pub. Date: Nov. 27, 2003

(65) Prior Publication Data

US 2004/0261197 A1 Dec. 30, 2004

(30) Foreign Application Priority Data

May 16, 2002 (KR) ..... 10-2002-0027132
Nov. 25, 2002 (KR) ..... 10-2002-0073611
Nov. 26, 2002 (KR) ..... 10-2002-0074057

(51) Int. Cl.
*D06F 37/30* (2006.01)

(52) U.S. Cl. ..... 8/159; 68/12.24; 68/133

(58) Field of Classification Search ..... 68/12.24, 68/23.6, 23.7, 133, 140; 8/158, 159; 192/17 C, 192/17 D, 18 R, 18 B, 12 D, 69.8, 71, 79, 192/84.6

See application file for complete search history.

(56) References Cited

U.S. PATENT DOCUMENTS 5,396,413 A * 3/1995 Kaneko et al. ..... 700/1
5,551,261 A 9/1996 Lyu et al.

(Continued)

FOREIGN PATENT DOCUMENTS

KR 100122858000 B1 9/1997
KR 1998-046473 9/1998
KR 1999-18530 3/1999

*Primary Examiner*—Joseph L Perrin
(74) *Attorney, Agent, or Firm*—McKenna Long & Aldridge LLP

(57) ABSTRACT

Device and method for detecting malfunction of a clutch in a washing machine, the device including a clutch including a coupling for transmission of a power from a motor to a washing shaft or a spinning shaft, a clutch motor (60) for providing a power to the coupling, a switch for controlling the coupling, and a cam (600) fitted to be rotatable with the clutch motor for turning on/off the switch in response to the rotation, a power supplying part for supplying a voltage to the motor and the clutch motor (60), a pulse counting part for counting a number of pulses of a voltage supplied to the clutch motor from the power supplying part, and a microcomputer for repeating a process in which the clutch motor is stopped for a second set time period (S20) and operated again if the switch is not switched for a first set time period from a time the clutch motor is put into operation, and informs to a user that the clutch is in malfunction if the switch is not switched while the process is repeated equal to or more than a set times, thereby determining the clutch of being out of order and informing a result of the determination to a user.

21 Claims, 15 Drawing Sheets

U.S. PATENT DOCUMENTS 6,257,027 B1 * 7/2001 Imai ..... 68/12.12
6,332,343 B1 12/2001 Koketsu et al.
7,082,792 B2 * 8/2006 Ahn ..... 68/12.24
7,086,254 B2 * 8/2006 Lim et al. ..... 68/23.7
7,089,769 B2 * 8/2006 Lim et al. ..... 68/23.6
7,171,715 B2 * 2/2007 Yoon et al. ..... 8/159
7,254,965 B2 * 8/2007 Ahn ..... 68/12.24
2005/0120759 A1 * 6/2005 Choi et al. ..... 68/133

* cited by examiner (A) Impeller rotating mode (B) Tub rotating mode

APPARATUS AND METHOD FOR DETECTING MALFUNCTION OF A CLUTCH OF WASHING MACHINE

TECHNICAL FIELD

The present invention relates to washing machines, and more particularly, to device and method for detecting malfunction of a clutch in a washing machine.

BACKGROUND ART

In general, the washing machine removes various dirt stuck to clothes, beddings, and the like by using softening action of detergent, friction caused by circulation of water coming from rotation of a pulsator, and impact applied to the laundry by the pulsator, wherein an amount and kinds of laundry is detected with sensors to set a washing method automatically, washing water is supplied appropriately according to the amount and kinds of the laundry, and the washing is carried out under the control of a microcomputer.

A related art full automatic washing machine is operated in two methods, one of which is transmission of a rotating power from a driving motor to a washing shaft or a spinning shaft with a power transmission belt or pulley, for rotating the pulsator or a spinning tub, and the other of which is rotating a washing and spinning tub at different speeds in washing and spinning under the speed control of a brushless DC motor.

However, the related art washing machine has a problem in that malfunction of a clutch used for shifting a power transmission path can not be detected failing to prevent damage of the washing machine caused by the clutch. Moreover, even if the motor is stopped, the unavailability of means for braking the washing tub in the case of damage to the clutch is a hazard to the user.

DISCLOSURE OF INVENTION

An object of the present invention is to provide device and method for detecting malfunction of a clutch in a washing machine, designed to solve the related art problem, in which malfunction of the clutch is determined, and a result of the determination is informed to a user, for prevention of malfunction and damage to the clutch.

The object of the present invention can be achieved by providing a device for detecting malfunction of a clutch in a washing machine including a clutch including a coupling for selective transmission of a power from a motor either to a washing shaft or a spinning shaft, a clutch motor for driving the coupling, and a cam fitted to be rotatable with the clutch motor for providing a switching signal in response to the rotation, a power supplying part for supplying a voltage to the clutch motor, a pulse counting part for counting a number of pulses of a voltage supplied to the clutch motor from the power supplying part, and a microcomputer for repeating a process in which the clutch motor is stopped for a second set time period and operated again if the cam fails to provide a switching signal for a first set time period, and determines that the clutch is in malfunction if the failure of providing the switching signal lasts while the process is repeated equal to or more than a set times.

In another aspect of the present invention, there is provided a device for detecting malfunction of a clutch in a washing machine including a clutch including a coupling for transmission of a power from a motor to a washing shaft or a spinning shaft, a clutch motor for providing a power to the coupling, a switch for controlling the coupling, and a cam fitted to be rotatable with the clutch motor for turning on/off the switch in response to the rotation, a power supplying part for supplying a voltage to the motor and the clutch motor, a pulse counting part for counting a number of pulses of a voltage supplied to the clutch motor from the power supplying part, and a microcomputer for repeating a process in which the clutch motor is stopped for a second set time period and operated again if the switch in not switched for a first set time period from a time the clutch motor is put into operation, and informs to a user that the clutch is in malfunction if the switch is not switched while the process is repeated equal to or more than a set times.

In further aspect of the present invention, there is provided a device for detecting malfunction of a clutch in a washing machine having a motor and a clutch including a speed sensing part of sensing a rotating speed of the motor, a microcomputer for determining the clutch of being out of order depending on re-acceleration of the motor during a preset time period after finish of braking of the motor, and a display part for displaying a message informing the clutch being out of order under the control of the microcomputer.

In still another aspect of the present invention, there is provided a device for detecting malfunction of a clutch in a washing machine including a clutch including, a coupling for transmission of power to a washing shaft or a spinning shaft from the motor, a clutch motor for providing the power to the coupling, and a clutch driving part for driving the clutch motor, a voltage sensing part for sensing a voltage from the power supplying part to the motor driving part, a coupling position sensing part for sensing a position of the coupling, and a microcomputer for determining the clutch of being out of order if a voltage level sensed through the voltage sensing part is higher than a set voltage level.

In still further aspect of the present invention, there is provided a method for detecting malfunction of a clutch in a washing machine, including the steps of (a) putting the clutch motor into operation for rotating the cam. (b) determining if the cam provides a switching signal, (c) repeating a process in which the clutch motor is stopped for a second set time period and operated again if the cam fails to provide the switching signal for a first set time period, and (d) displaying an error message if the cam fails to provide the error message while the process is repeated more than a set number of times.

In yet another aspect of the present invention, there is provided a method for detecting malfunction of a clutch in a washing machine, including the steps of (a) putting the clutch motor into operation for rotating the cam, (b) determining if the switch is switched or not, (c) repeating a process in which the clutch motor is stopped for a second set time period and operated again if the switch is not switched for a first set time period, and counting a number of repeated times of the process, (d) displaying an error message if the switch is not switched while the process is repeated more than a set number of times.

In yet further aspect of the present invention, there is provided a method for detecting malfunction of a clutch in a washing machine, including the steps of (a) determining finish of braking of the motor when a user applies a braking order, (b) determining re-acceleration of the motor for a set time period when the braking of the motor is finished, (c) determining the clutch being out of order is the motor is re-accelerated, and displaying a message informing the clutch is out of order.

In still yet another aspect of the present invention, there is provided a method for detecting malfunction of a clutch in a washing machine including the steps of (a) sensing a level of a voltage supplied from the power supplying part to the motor driving part, (b) comparing a sensed voltage level to a set voltage level, and (c) determining the clutch of being out of order if the sensed voltage level is higher than the set voltage level.

BRIEF DESCRIPTION OF DRAWINGS

The accompanying drawings, which are included to provide a further understanding of the invention, illustrate embodiment(s) of the invention and together with the description serve to explain the principle of the invention. In the drawings.

BEST MODE FOR CARRYING OUT THE INVENTION

Figure 1:
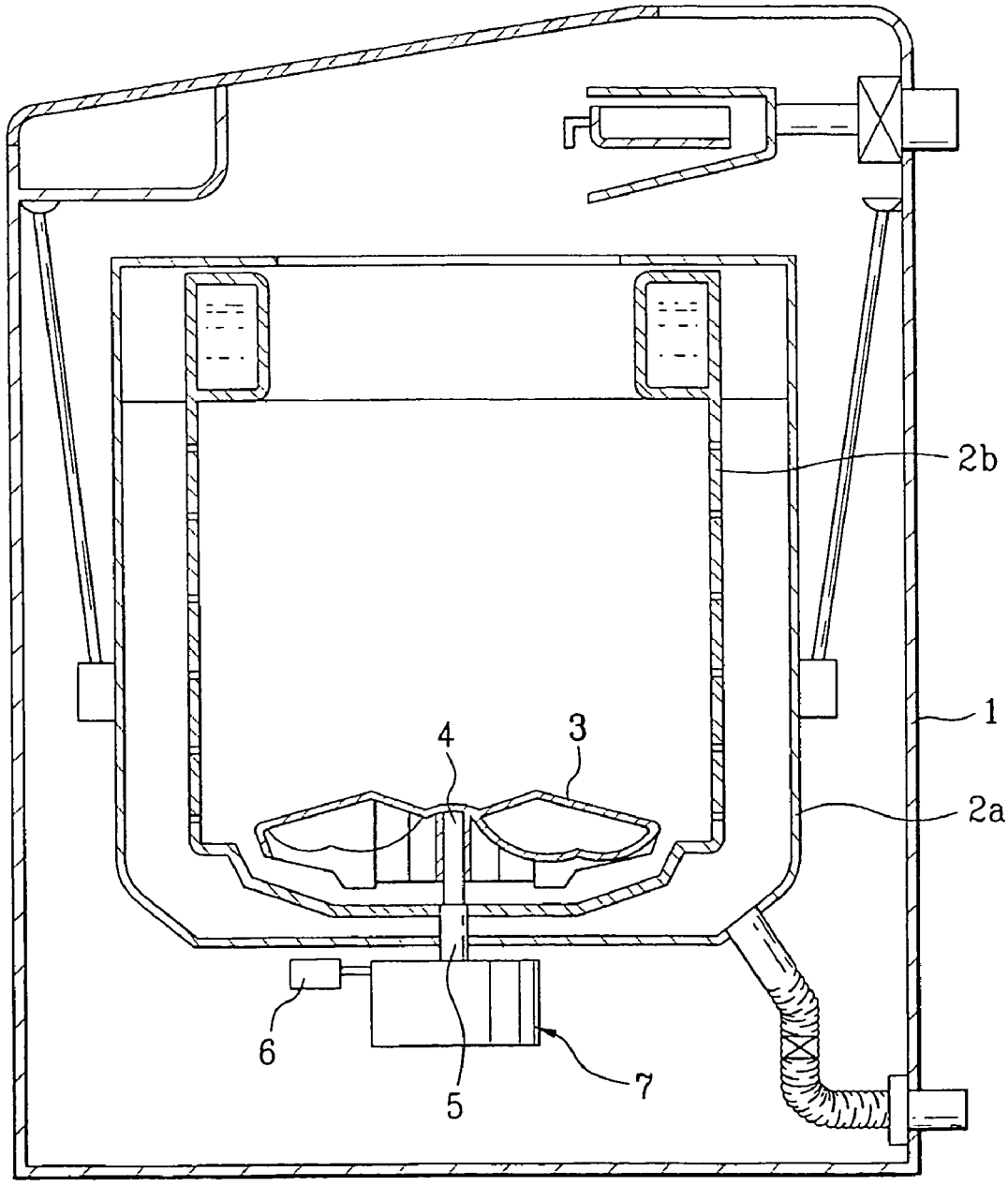
FIG. 1 illustrates a washing machine in accordance with a preferred embodiment of the present invention, schematically.

Reference will now be made in detail to the preferred embodiments of the present invention, examples of which are illustrated in the accompanying drawings. In describing the embodiments, same parts will be given the same names and reference symbols, and repetitive description of which will be omitted. FIG. 1 illustrates a washing machine in accordance with a preferred embodiment of the present invention, schematically;

Referring to FIG. 1, the full automatic washing machine includes a body l, an outer tub 2*a* mounted in the body 1, and an inner tub 2*b* rotatably mounted in the outer tub 2*a*. There is a pulsator 3 mounted on a central part of a bottom of an inside of the inner tub 2*b* for rotating in left and right directions alternately in washing and spinning.

The full automatic washing machine also includes a spinning shaft 5 for transmission of a rotating power to the inner tub 2*b*, a washing shaft 4 for transmission of rotating power to the pulsator 3, and a clutch 6 for transmission of a power of the motor 7 to either the washing shaft 4 or the spinning shaft 5 depending on a cycle of being a washing cycle or a spinning cycle.

Figure 2A:
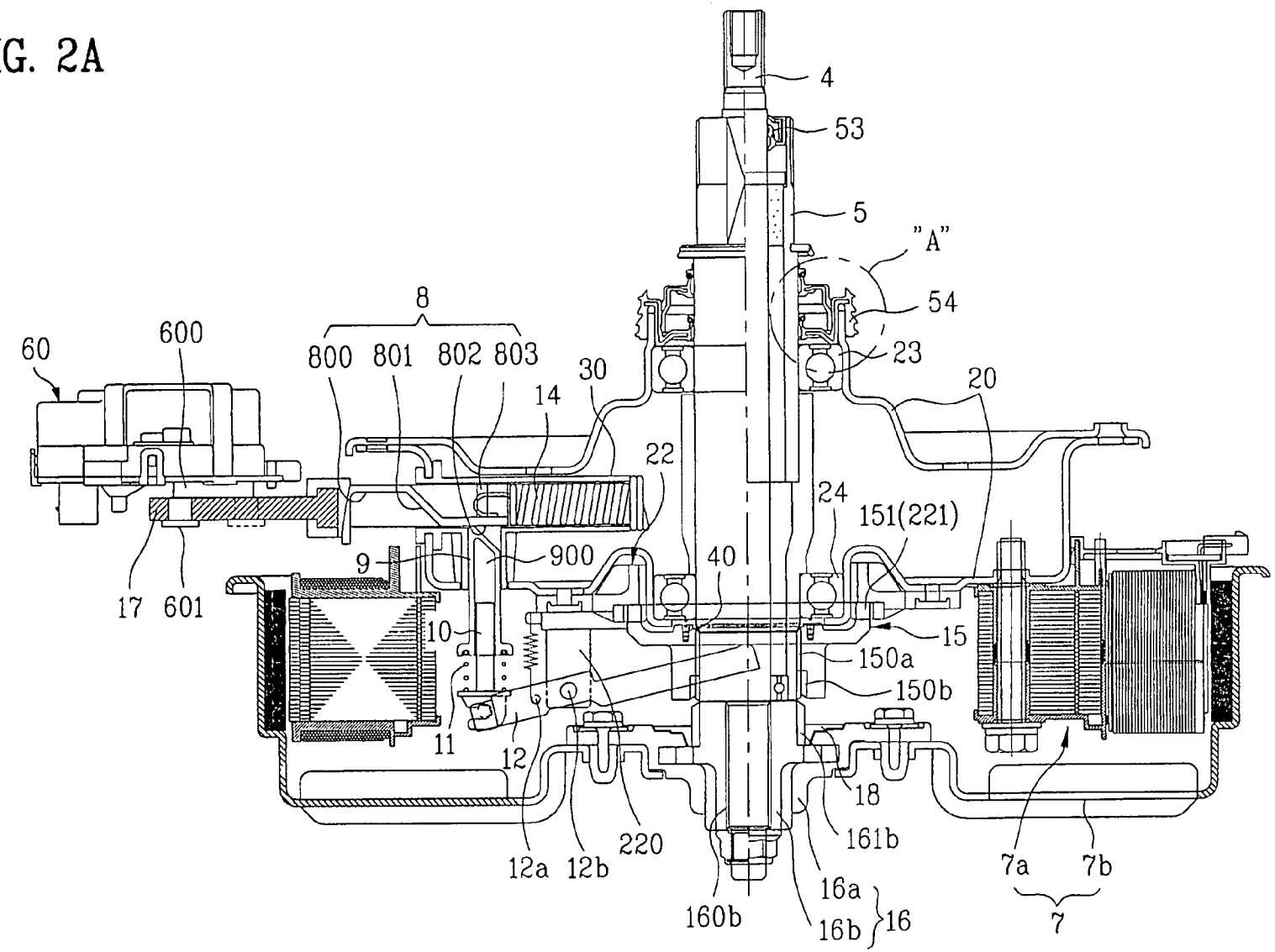
FIG. 2 illustrate sections of the clutch and motor in FIG. 1, respectively.
Figure 2B:
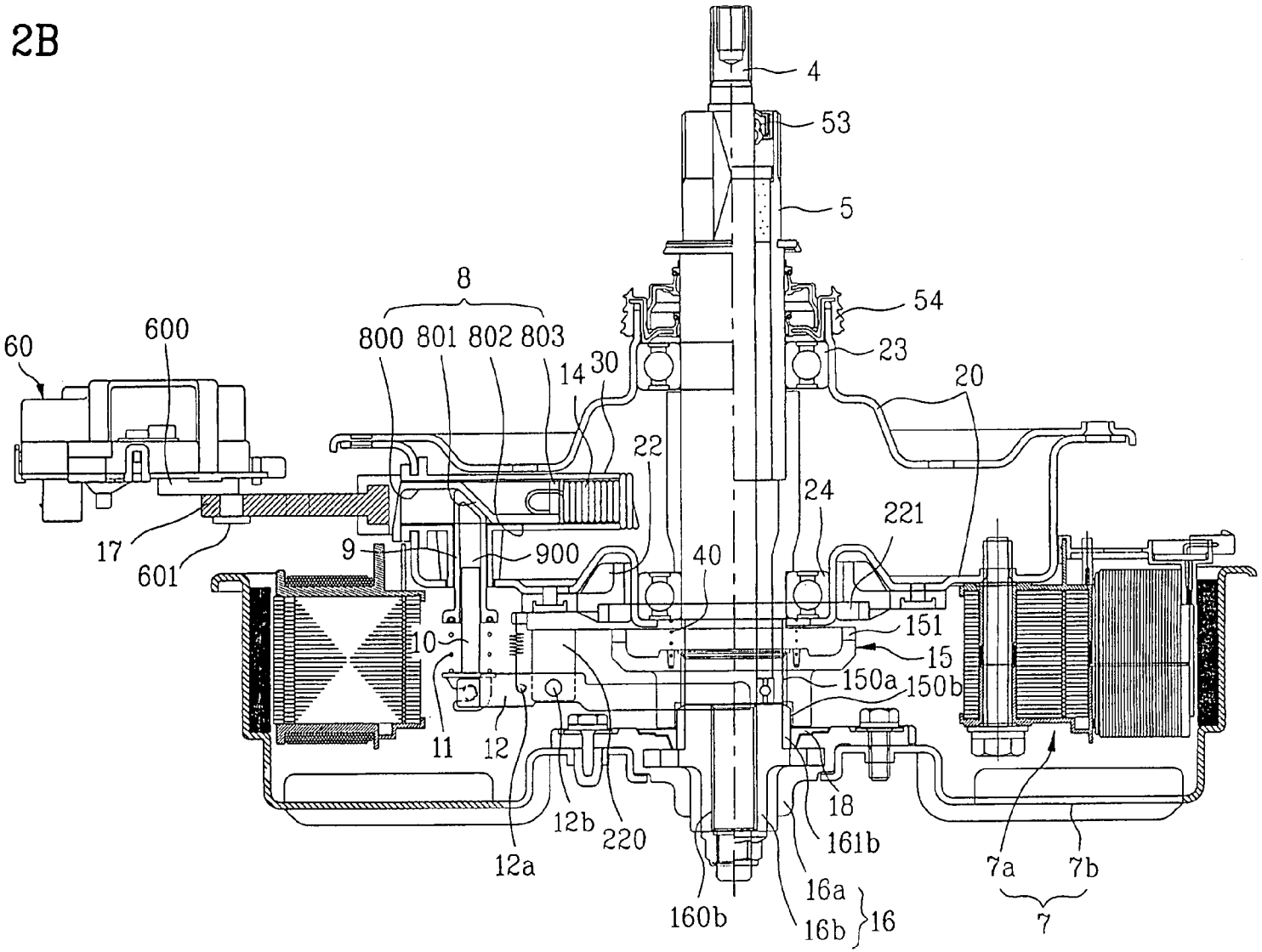

The clutch 6 has the following system. Referring to FIGS. 2A and 2B, there is a clutch motor 60 under the outer tub 1, and a cam 600 mounted on a driving shaft 602 of the clutch motor 60. There are a lever guide 30 fixed in a shaft support bearing case 20, and a lever 8 having a recess 800 with a sloped surface 801, and a flat surface 802 extended in a horizontal direction from a lower end of the sloped surface 801 for making a linear motion guided by the lever guide when the clutch motor 60 is driven. There is a connecting rod 17 between the cam 600 and lever of the clutch motor 60 for pulling the lever 8 toward the clutch motor 60 when the clutch motor 60 is turned on. There is a return spring 14 fastened between one end of the lever guide 30 and a projection 803 from the lever 8, for giving a restoring force to the lever 8 when the lever 8 moves away from an end of the lever guide 30. There is a cylindrical hollow mover 9 for engaging with the recess 800 in the lever 8 in spinning, and moving down along the sloped surface 801 until the mover 9 stops at an underside of the flat surface 802 in turning to a washing mode. There are a plunger 10 fitted movable up/down along a guide groove 900 inside of the mover 9, and a damping spring 11 between the mover 9 and the plunger 10. There is a coupling stopper 22 having gear teeth 221 formed along a circumferential direction of the shaft support bearing case 20 fixed to an underside of the shaft support bearing case 20. There is a fork formed rod 12 having a fore end of one side hinge coupled with a lower end of the plunger 10, and a point of a middle part hinge coupled with a lower end of a support bracket 220 formed below the coupling stopper 22, for making a seesaw movement around the point of the middle part when the plunger 10 moves up/down. There is a coupling 15 fitted to be movable up/down along the spinning shaft 5 for shifting a rotation power transmission path. There is a connector assembly 16 for transmission of a rotation power of the rotor 7*b* to the washing shaft 4.

Figure 3:
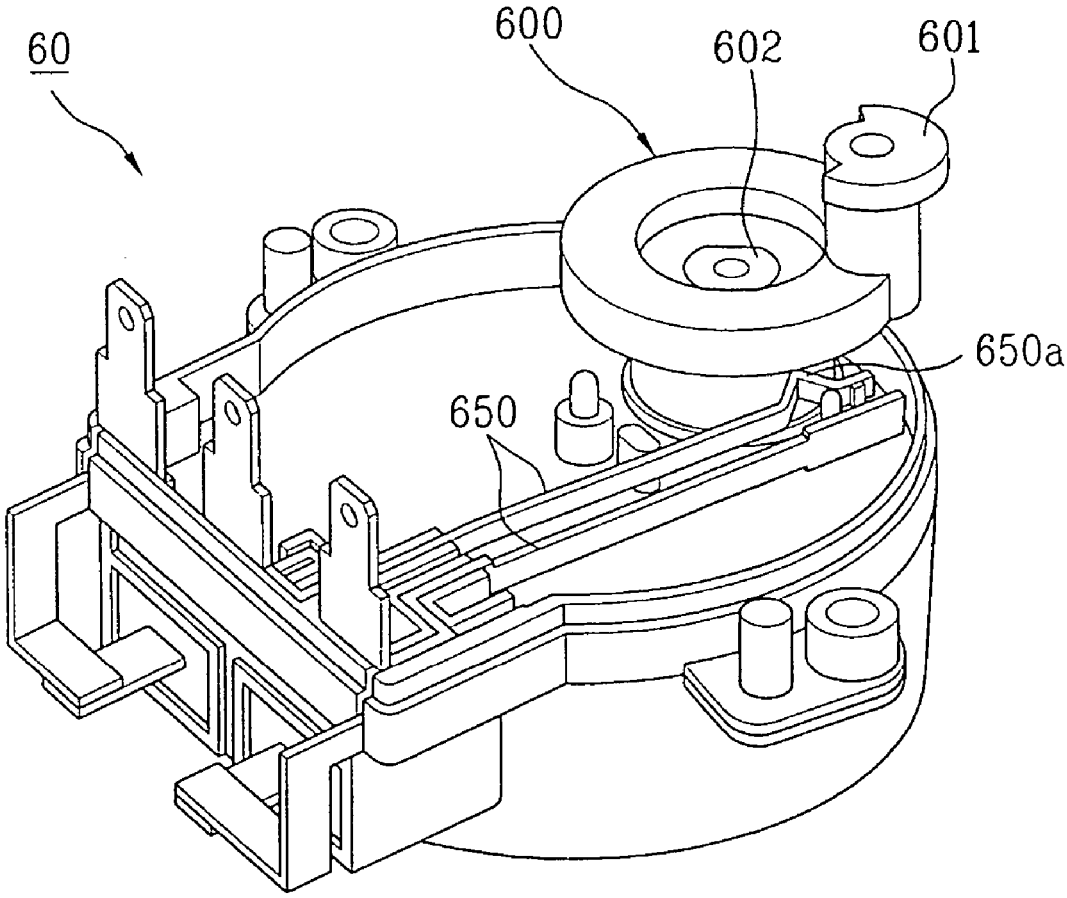
FIG. 3 illustrates a perspective view of a clutch motor in accordance with a preferred embodiment of the present invention.
Figure 4:
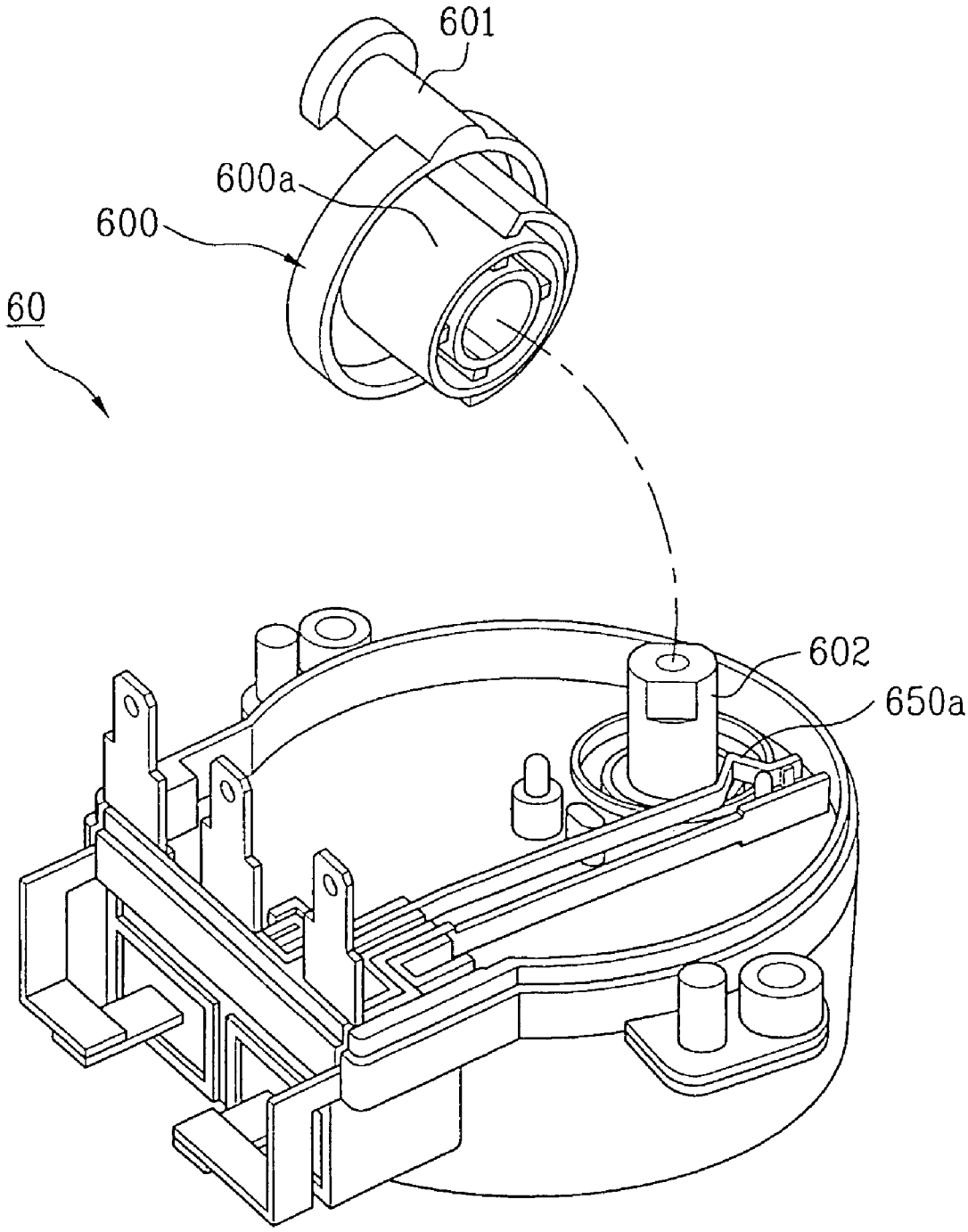
FIG. 4 illustrates a disassembled perspective view of FIG. 3 FIGS. 5A~5C illustrate an operative relations between a cam and a switch when the clutch motor is driven.

Referring to FIGS. 3 and 4, the cam 600 on the driving shaft 602 moves together with the driving shaft 602 and stops where the driving shaft 602 stops.

A relation of movements of the cam 600 and the switch 650 will be described. When the cam 600 is in a state consistent to an initial point, the switch 650 is in a turned off state. As shown in FIG. 5C, the state consistent to an initial point of the cam 600 is a state a rod connecting shaft 601 of the cam 600 is at an initial point.

When it is intended to shift the power transmission path for washing, the clutch motor 60 is put into operation, to turn the cam 600 in an anti-clockwise direction. Since a projection 650*a* from the switch 650 is on a cam recess surface 600*a* until a rotation angle of the cam 600 reaches to 150° from the initial point, the switch 650 is in a turned off state.

Thereafter, since the projection 650*a* from the switch 650 leaves the cam recess surface 600*a* as the rotation angle of the cam 600 reaches to 1500 from the initial point, the switch 650 is turned on.

When the rotation angle of the cam 600 reaches to 150° from the initial point, gear teeth 151 of the coupling 15 and the gear teeth 221 of the coupling stopper 22 come into engagement.

Figure 5A:
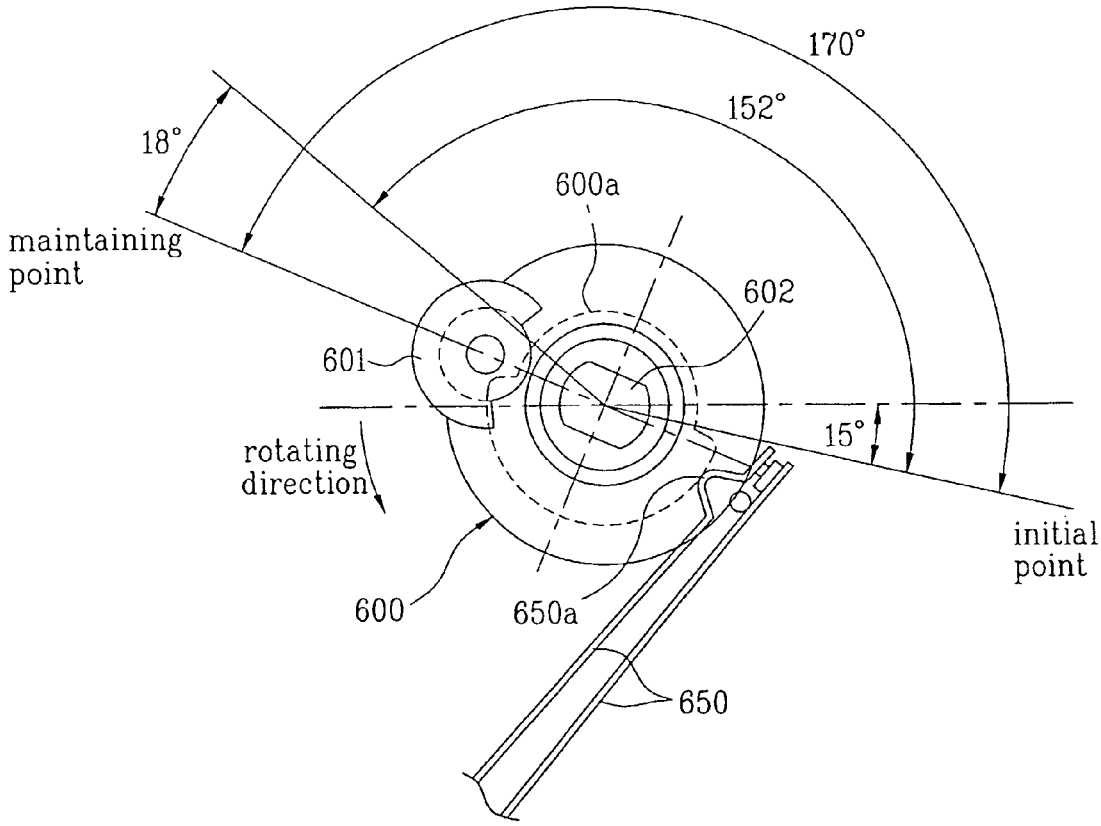

Then, referring to FIG. 5A, when the cam 600 reaches to a point which is 170° from the initial point, the clutch motor 60 is made to turn off. The reason that the clutch motor 60 is made to turn off at a point consistent to a maintaining point of the cam 600 is for more firm power shift to the washing mode.

Figure 5B:
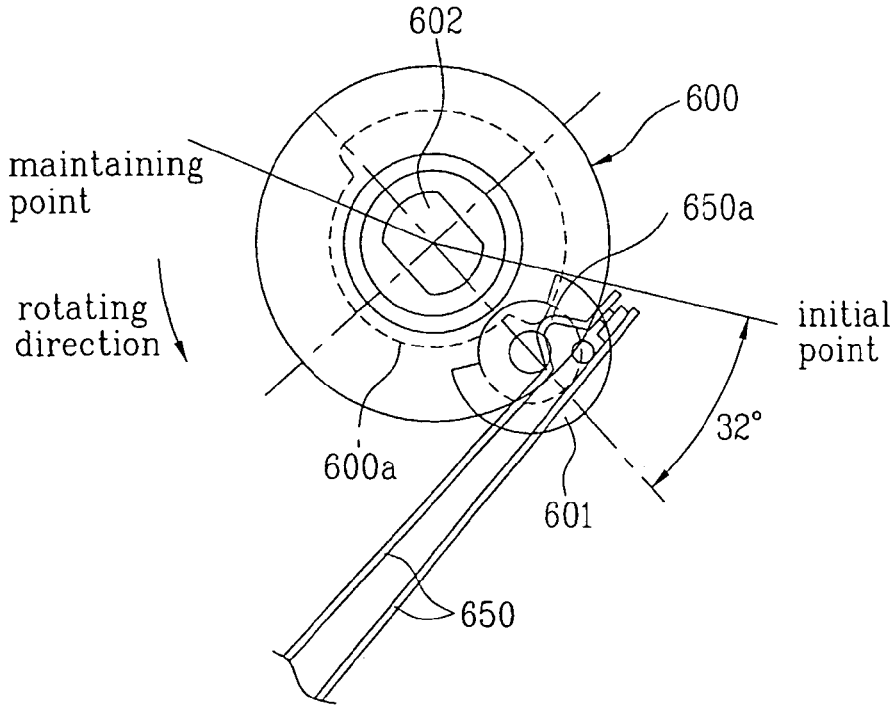
Figure 5C:
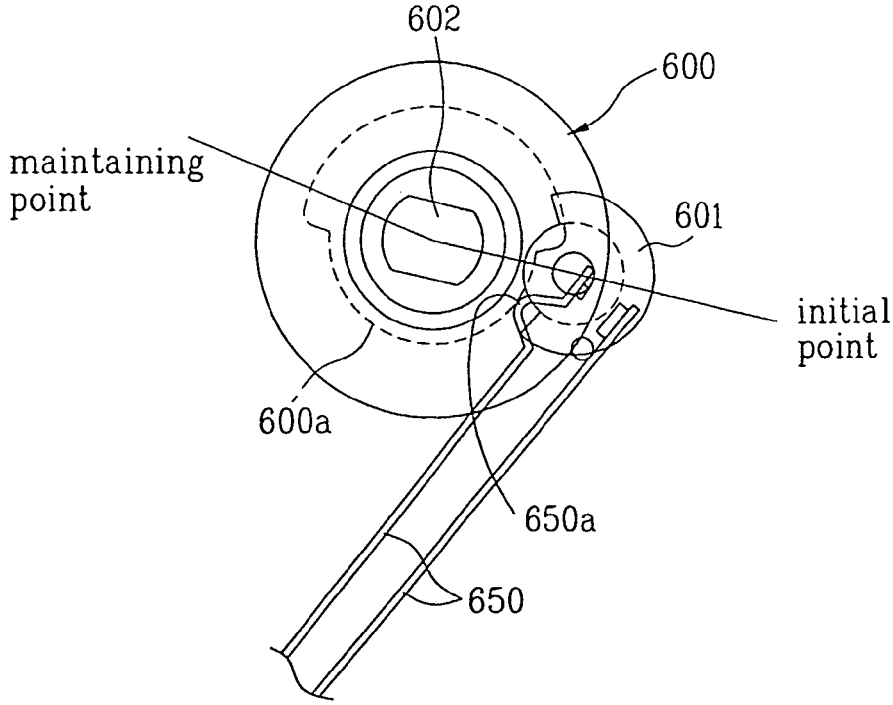
Figure 6:
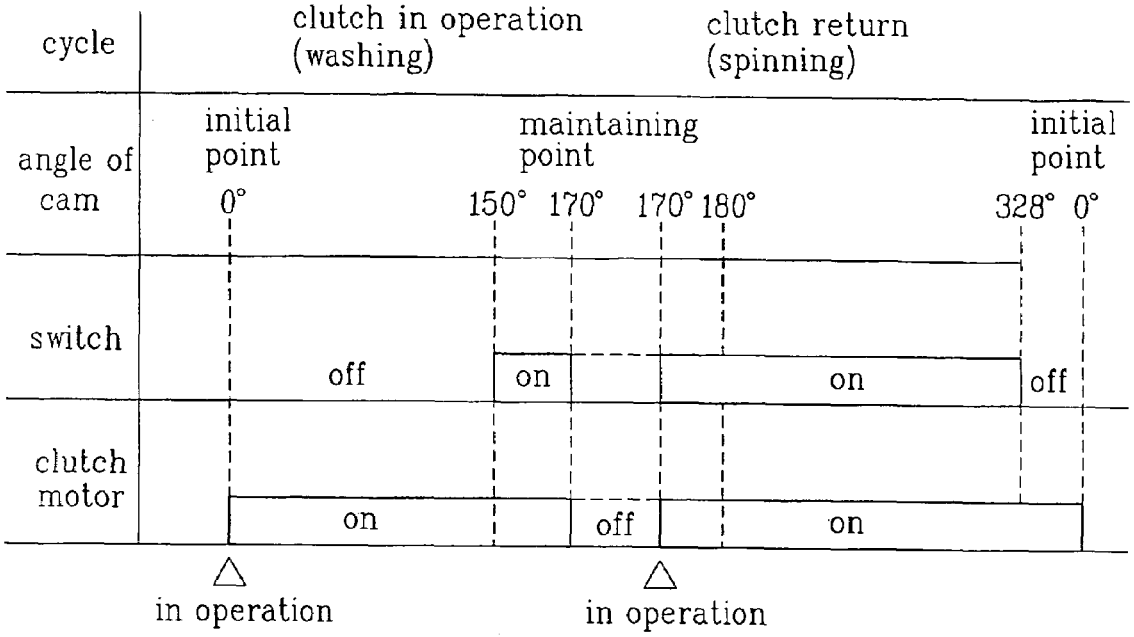
FIG. 6 illustrates a chart for describing operation among a clutch motor, a cam, and a switch.

In the meantime, in spinning after finish of washing, it is required to return of a position consistent to the initial point. To do this, at the time of power shift to the spinning tub mode, the clutch motor 60 is turned on again, to turn the cam 600 in the anti-clockwise direction. In this instance, as shown in FIG. 5B, the switch 650 maintains a turned on state until the cam 600 passes a point which is 328° from the initial point in the anti-clockwise direction (a point 158° from the maintaining point in the anti-clockwise direction), when the projection 650*a* from the switch 650 comes to the cam recess surface 600*a*, to turn off the switch 650.

Thereafter, even if the switch 650 is turned off, the clutch motor 60 maintains a turned on state until the cam 600 reaches to a point consistent to the initial point under the control of the microcomputer, when the clutch motor 60 is turned off. In this instance, a number of pulses of an AC power supplied to the clutch motor 60 are counted while the clutch motor 60 is maintained in the turned on state starting from a time right after the switch 650 is turned off to a time the cam 600 reaches to a point consistent to the initial point. By using the number of the pulses, the clutch motor 60 is controlled.

In the meantime, in a state the cam 600 is at the initial point, not only the gear teeth 151 of the coupling 15 and the gear teeth 221 of the coupling stopper 22 are disengaged, but also an upper serration 150*a* and a lower serration 150*b* are engaged with a serration 161*b* on an outside circumferential surface of an upper part of an inner connector 16*b* and a serration on a lower part of the spinning shaft 5 respectively at the same time, the spinning by simultaneous rotation of the washing shaft 4 and the spinning shaft 5 is carried out.

Referring to FIG. 2B, before starting washing, the clutch 6 of the present invention is in a turned off state when no power is applied to the clutch motor 60, and the coupling 15 is in a moved down state. In this instance, the mover 9 is positioned in the recess 800 with the sloped surface 801 of the lever 8.

In this state, when power is applied to the clutch motor 60, to turn on the clutch motor 60, driving power of the clutch motor 60 is transmitted to the cam 600, the connecting rod 17 moves toward the clutch motor 60 as the cam 600 rotates, and, according to this, the lever 8 is pulled toward the clutch motor 60 along the lever guide 30. In this instance, the return spring 14 at a rear end of the lever guide 30 is extended.

In the meantime, the mover 9 brought into contact with the sloped surface 801 of the lever 8 when the cam 600 rotates, moves down along the sloped surface 801, until the mover 9 comes to the underside of the flat surface 802 of the lever 8 as shown in FIG. 2A at a time the cam 600 comes to the maintaining point.

While the mover 9 moves down following rotation of the cam 600 and moving of the lever 8 toward the clutch motor, the mover 9 compresses the damping spring 11, and, according to this, the plunger 10 fitted to be movable along the guide groove 900 also moves down.

In succession to this, following the move down of the plunger 10, the rod 12 hinge coupled with the plunger 10 rotates around a fastening pin 12*b* at the point of the middle part of the rod 12 passed through the support bracket 220 of the coupling stopper 22 in the anti-clockwise direction.

While the rod 12 rotates around a fastening pin 12*b* in the anti-clockwise direction, an end of the rod 12 is brought into contact with, and pushes up the coupling 15 along the spinning shaft 5 in an upper part of the shaft. According to this, as shown in FIG. 2A, when the power shift to the washing mode is finished, the gear teeth 151 on the upper part of the coupling 15 are engaged with the gear teeth 221 on the coupling stopper 22.

When the gear teeth 151 on the coupling 15 are engaged with the gear teeth 221 on the coupling stopper 22, the coupling 15 is freed from the connector assembly 16, such that only the washing shaft 4 rotates when the rotor 7*b* rotates. That is, in washing, because the coupling 15 is engaged only with the serration on the outside circumferential surface of the spinning shaft 5, but not with the serration on the upper part of the inner connector 16*b* engaged with the washing shaft 4, the rotation power is transmitted from the rotor 7 only to the pulsator 3 through the washing shaft 4.

In the state the gear teeth 151 on the coupling 15 are engaged with the gear teeth 221 on the coupling stopper 22, rotation of the coupling 15 is prevented by the gear teeth 221 on the coupling stopper 22.

Referring to FIG. 2A, when shift of a power transmission path to the spinning tub mode is required for progressing spinning as the washing is finished while the washing is progressed, power is applied to the clutch motor 60 again, to drive the clutch motor 60, and rotate the cam 600.

When the cam 600 of the clutch motor 60 rotates to a spinning position, the lever 8 moves away from the clutch motor 60 by a restoring force of the return spring 14. According to this, as shown in FIG. 2B, the mover 9 in contact with the flat surface 802 of the lever 8 is positioned in the recess 800 with the sloped surface 801 of the lever 8 at the time returning of the lever 8 is finished.

At the time the mover 9 moves up following the movement of the lever 8, the compression on the damping spring is eased, and, according to this, the plunger 10 moves up along the guide groove 900 in the mover 9. Following the move up of the plunger 10, the rod 12 hinge coupled to the plunger 10 turns around the fastening pin 12*b* in a clockwise direction when the drawing (FIG. 2A) is seen from above.

Following the clockwise direction rotation of the rod 12 around the fastening pin 12*b*, the force of an end of the rod 12 which supports the coupling 15 is eliminated. Then, the coupling moves down by gravity and the restoring force of the compression spring 40, and, according to this, the gear teeth 151 of the coupling 15 is disengaged from the gear teeth 221 of the coupling stopper 22.

When the coupling moves down fully, the serrations 150*a* and 150*b* on an inside circumferential surface of the coupling 15 are engaged with the serration 161*b* and the serration in a lower part of the spinning shaft 5, so that spinning is carried out as the spinning of the washing shaft 4 and the spinning shaft 5 are carried out at the time of spinning of the rotor 7*b*.

First Embodiment

Figure 7:
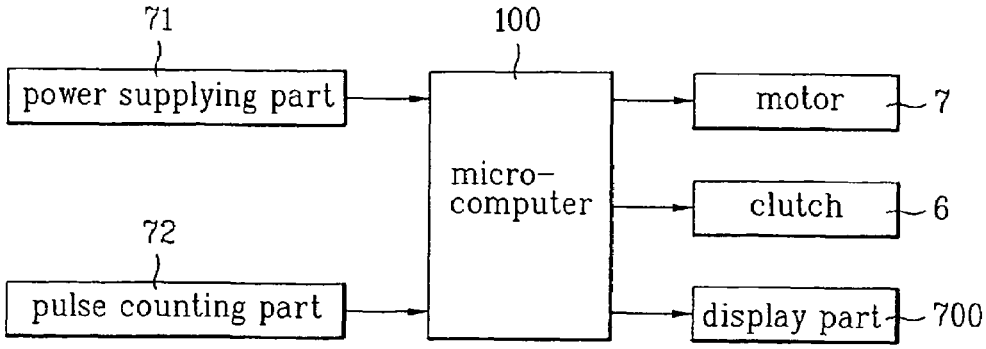
FIG. 7 illustrates a block diagram of a device for detecting malfunction of a clutch in accordance with a first preferred embodiment of the present invention.

Referring to FIG. 7, a device for detecting malfunction of a clutch in a washing machine of the present invention includes a power supplying part 71, a pulse counting part 72, a microcomputer 100, a motor 7, a clutch 6, and a display part 700.

Referring to FIGS. 3 and 4, the clutch 6 includes a clutch motor 60 for moving up/down a coupling 15 proper to a washing or spinning cycle, and a cam 600 fitted to be rotatable with the clutch motor 60 for providing a switching signal in response to the rotation.

The power supplying part 71 supplies a voltage to the motor 7 and the clutch motor 60, and the pulse counting part 72 counts a number of pulses of an AC power supplied to the clutch motor 60 from the power supplying part 71.

If the cam 600 fails to provide a switching signal within a preset time period after the clutch motor 60 is put into operation, the microcomputer 100 turns off the clutch motor 60, and puts the clutch motor 60 into operation again, and redetermines if the cam 600 provides the switching signal. If the cam 600 fails to provide the switching signal, the microcomputer 100 repeats a process of the putting the clutch motor 60 into operation again and the re-determining if the cam 600 provides the switching signal. If the cam 600 fails to provide the switching signal even if the process is repeated for a preset times, the microcomputer 100 determines that the clutch 6 is not in order. Then, the microcomputer 100 provides a control signal for displaying an error message or generating a signal sound. That is, the microcomputer 100 counts a number of times the cam 600 fails to provide the switching signal and if the counted number of times is greater than a preset number of times, the microcomputer 100 makes the display part 700 to display the error message, or generates the signal sound.

When the cam 600 generates the switching signal normally, the microcomputer 100 uses a counted number of pulses of the pulse counting part 72 for maintaining driving of the clutch motor 600 for a preset time period. That is, that is, driving of the clutch motor 600 is continued until the counted number of pulses reaches to a preset number of pulses.

A method for detecting malfunction of a clutch in a washing machine in accordance with a first preferred embodiment of the present invention will be described for two modes, separately. One of the modes is a pulsator mode employed in washing or rinsing, and the other one is a spinning tub mode employed in spinning.

Of the methods for shifting a power transmission mode of a washing machine, a process for shifting to the pulsator mode will be described.

Figure 8:
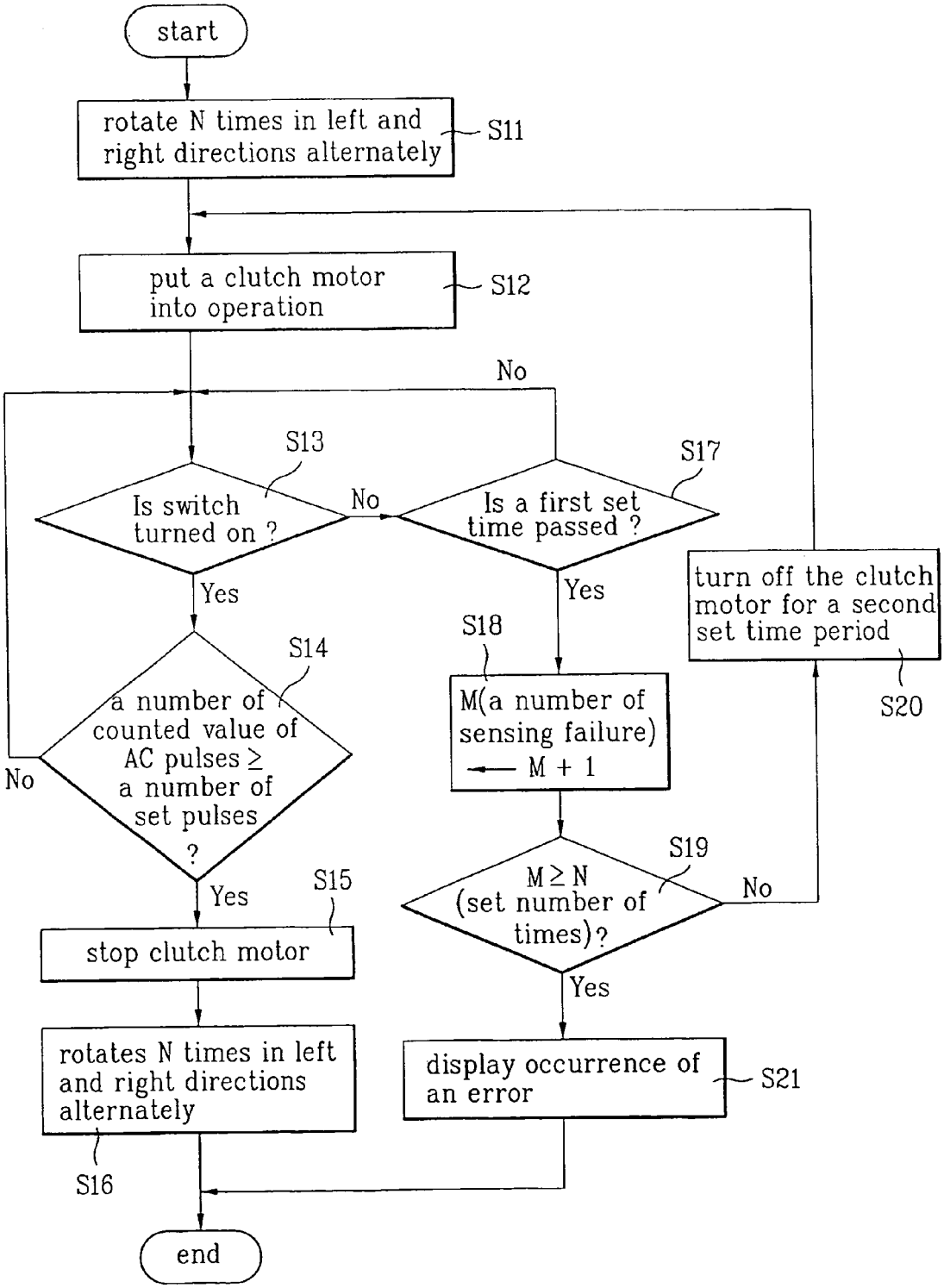
FIGS. 8 and 9 illustrate flow charts each showing the steps of a method for detecting malfunction of a clutch in accordance with a first preferred embodiment of the present invention.

Referring to FIG. 8, under the control of the microcomputer 100, the BLDC motor 7 is alternately rotated in left and right directions momentarily for N times (for an example, two times) or a preset time period (one to three seconds) at an rotation angle smaller than a rotation angle in washing (S11).

The BLDC motor 7 is alternately rotated in left and right directions in the step S1, for eliminating a cause that impedes moving up of the coupling 15. The moving up of the coupling 15 is impeded by surface pressures of the serrations 150*a* and 150*b* exerted to the serration on the lower part of the spinning shaft D and the serration 161*b* on the upper part of the inner connector 16*b* in opposite directions caused by opposite direction forces of the spinning shaft 5 and the inner connector 16*b* engaged with the coupling 15 at stopping of the washing machine. Therefore, before proceeding to the step for moving up the coupling 15 to a position of the washing mode, the BLDC motor 7 is alternately rotated in left and right directions for eliminating the cause that impedes moving up of the coupling 15.

Then, the microcomputer 100 puts the clutch motor 60 into operation for rotating the cam 600 (S12). Then, the microcomputer 100 determines if the switch 650 is turned on by the rotation of the cam 600 (S13). The turn on of the switch 650 means that engagement of the gear teeth 151 of the coupling 15 with the gear teeth 221 of the coupling stopper 22. Therefore, by determining a turned on state of the switch 650, it can be known that whether the engagement of the gear teeth 151 of the coupling 15 with the gear teeth 221 of the coupling stopper 22 is done or not.

Then, as a result of the determination in the step S13, if it is determined that the switch 650 is turned on, the pulse counting part 72 counts a number of pulses of the AC voltage supplied to the clutch motor 60 while the switch 650 is in a turned on state. Then, the microcomputer 100 determines if the counted number of pulses is greater than a preset number of pulses, for an example, '66' (S14).

As a result of the determination in the step S14, if the counted number of pulses is smaller than the preset number of pulses, the process proceeds back to the step S13. Then, the step S13 and the step S14 are repeated until the counted number of pulses is equal to, or greater than the preset number of pulses. While the step S13 and the step S14 are repeated thus, driving of the clutch motor 60 is continued. Therefore, the engagement of the gear teeth 151 of the coupling 15 with the gear teeth 221 of the coupling stopper 22 becomes more positive.

Opposite to this, as a result of the determination in the step S14, if the counted number of pulses of the AC voltage is equal to or greater than the preset number of pulses, the clutch motor 60 is stopped (S15), and the BLDC motor 7 is alternately rotated in left and right directions momentarily (S16) under the control of the microcomputer 100. In this instance, the BLDC motor 7 is alternately rotated in left and right directions at an angle smaller than an angle in washing for N times (for an example, two times) or a preset time period (one to three seconds). The two times of left and right direction alternate rotation is made for preventing the BLDC motor 7 from putting into operation in a state the engagement of the gear teeth 151 of the coupling 15 with the gear teeth 221 of the coupling stopper 22 is not perfect caused by mechanical or motor malfunction, in advance.

In the meantime, as a result of the determination in the step S13, if the switch 650 is not turned on, pass of a first set time period, for an example, 7 seconds, from a time point the clutch motor 60 is put into operation is determined (S17).

Then, as a result of the determination in the step S17, if the first set time period is passed, the microcomputer 100 increases an 'M' (a number of switch turn on failed times) by '1' whenever failed (S18), and determines if 'M' is equal to or greater than 'N' (a set number of times, for an example, four times) (S19).

As a result of the determination in the step S19, if the 'M' is not equal to or greater than 'N', the clutch motor 60 is turned off for a second set time period, for an example, one second, (S20), and the clutch motor 60 is put into operation again (S12).

In the meantime, as a result of the determination in the step S19, if 'M' is equal to or greater than the set number of times 'N', the microcomputer 100 makes the display part 700 to display an error message (S21). That is, if the number of times the switch 650 is failed to turn on is equal to or greater than the preset number of times 'N', the microcomputer 100, determining that the cam 600 or the switch 650 is out of order, displays the error message on the display part 700.

Of the methods for shifting a power transmission mode of a washing machine of the present invention, a process for shifting to the spinning tub mode will be described.

Figure 9:
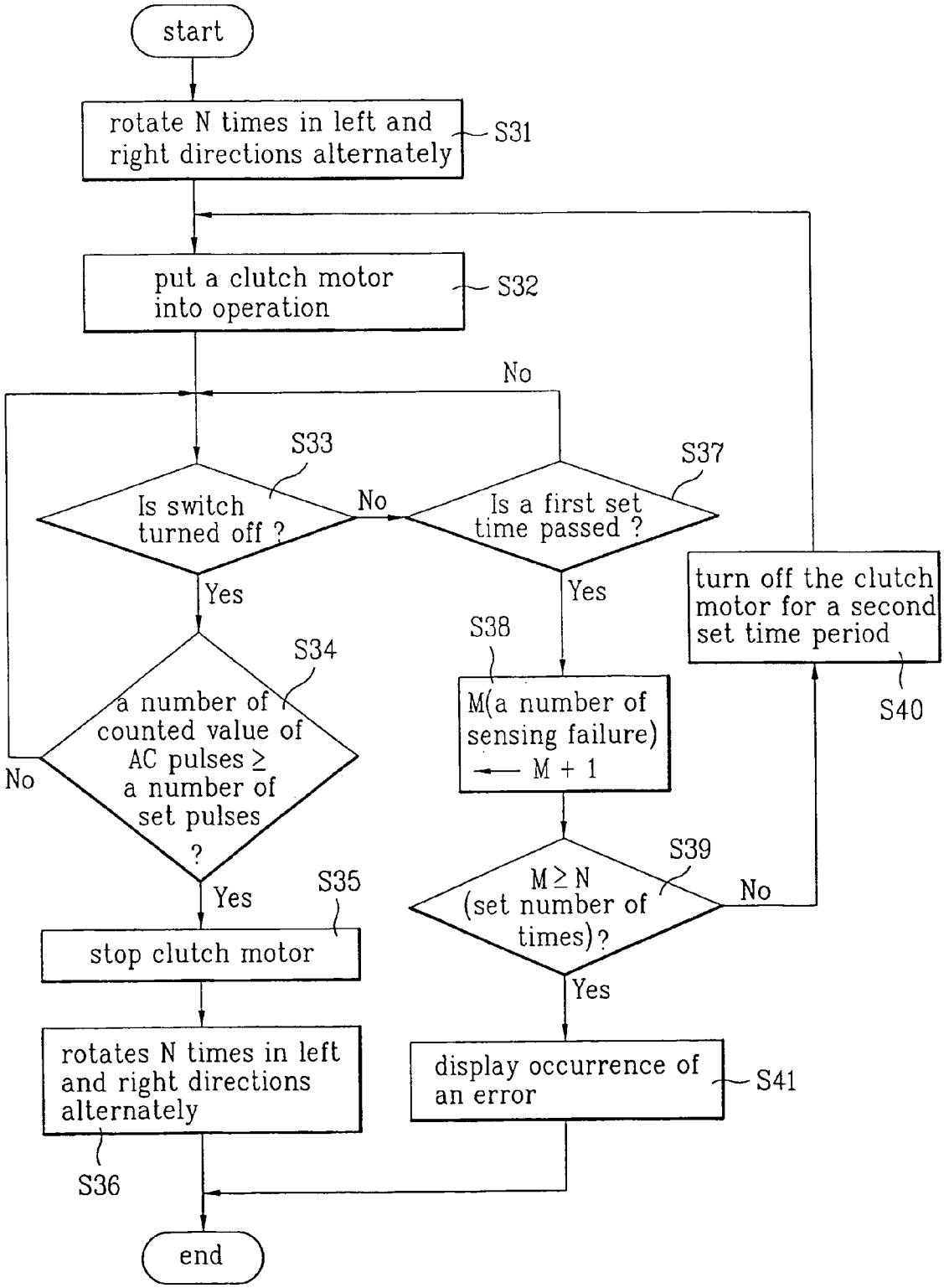

Referring to FIG. 9, under the control of the microcomputer 100, the BLDC motor 7 is alternately rotated in left and right directions momentarily for N times (for an example, two times) or a preset time period (one to three seconds) at an rotation angle smaller than a rotation angle in washing (S31).

The BLDC motor 7 is alternately rotated in left and right directions in the step S31, for eliminating a cause that impedes moving up of the coupling 15. The moving up of the coupling 15 is impeded by surface pressures of the serrations 150*a* and 150*b* exerted to the serration on the lower part of the spinning shaft 5 and the serration 161*b* on the upper part of the inner connector 16*b* in opposite directions caused by HHHH crossing of the spinning shaft 5 and the inner connector 16*b* engaged with the coupling 15. Therefore, before proceeding to the step for moving up the coupling 15 to a position of the washing mode, the BLDC motor 7 is alternately rotated in left and right directions for eliminating the cause that impedes moving up of the coupling 15.

Then, the microcomputer 100 puts the clutch motor 60 into operation for rotating the cam 600 (S32). Then, the microcomputer 100 determines if the switch 650 is turned off by the rotation of the cam 600 (S33). The turn off of the switch 650 means that disengagement of the gear teeth 151 of the coupling 15 with the gear teeth 221 of the coupling stopper 22. Therefore, by determining a turned off state of the switch 650, it can be known that whether the disengagement of the gear teeth 151 of the coupling 15 with the gear teeth 221 of the coupling stopper 22 is done or not.

Then, as a result of the determination in the step S33, if it is determined that the switch 650 is turned off, the pulse counting part 72 counts a number of pulses of the AC voltage supplied to the clutch motor 60 while the switch 650 is in a turned off state. Then, the microcomputer 100 determines if the counted number of pulses is greater than a preset number of pulses, for an example, 66' (S34).

As a result of the determination in the step S34, if the counted number of pulses is smaller than the preset number of pulses, the process proceeds back to the step S33. Then, the step S33 and the step S34 are repeated until the counted number of pulses is equal to, or greater than the preset number of pulses. While the step S33 and the step S34 are repeated thus, driving of the clutch motor 60 is continued. Therefore, the disengagement of the gear teeth 151 of the coupling 15 with the gear teeth 221 of the coupling stopper 22 becomes perfect.

Opposite to this, as a result of the determination in the step S34, if the counted number of pulses of the AC voltage is equal to, or greater than the preset number of pulses, the clutch motor 60 is stopped (S35), and the BLDC motor 7 is alternately rotated in left and right directions momentarily (S36) under the control of the microcomputer 100. In this instance, the BLDC motor 7 is alternately rotated in left and right directions at an angle smaller than an angle in washing for N times (for an example, two times) or a preset time period (one to three seconds). The two times of left and right direction alternate rotation is made for preventing the BLDC motor 7 from putting into operation in a state the disengagement of the gear teeth 151 of the coupling 15 with the gear teeth 221 of the coupling stopper 22 is not perfect caused by mechanical or motor malfunction, in advance.

In the meantime, as a result of the determination in the step S33, if the switch 650 is not turned off, pass of a first set time period, for an example, 7 seconds, from a time point the clutch motor 60 is put into operation is determined (S37).

Then, as a result of the determination in the step S37, if the first set time period is passed, the microcomputer 100 increases an 'M' (a number of switch turn off failed times) by '1' whenever failed (S38), and determines if 'M' is equal to or greater than a set number of times 'N' (for an example, four times) (S39).

As a result of the determination in the step S39, if the 'M' is not equal to or greater than the set number of times 'N', the clutch motor 60 is turned off for a second set time period, for an example, one second, (S40), and the clutch motor 60 is put into operation again (S32).

In the meantime, as a result of the determination in the step S39, if 'M' is equal to or greater than the set number of times 'N', the microcomputer 100 makes the display part 700 to display an error message (S41). That is, if the number of times the switch 650 is failed to turn off is equal to or greater than the preset number of times 'N', the microcomputer 100, determining that the cam 600 or the switch 650 is out of order, displays the error message on the display part 700.

Thus, the method for detecting malfunction of a clutch in accordance with a first preferred embodiment of the present invention detects malfunction of the clutch when the washing machine is shifted to the pulsator mode or the spinning tub mode, to permit to prevent damage to the washing machine caused by the malfunction of the clutch, and stable mode shifting.

Second Embodiment

Figure 10:
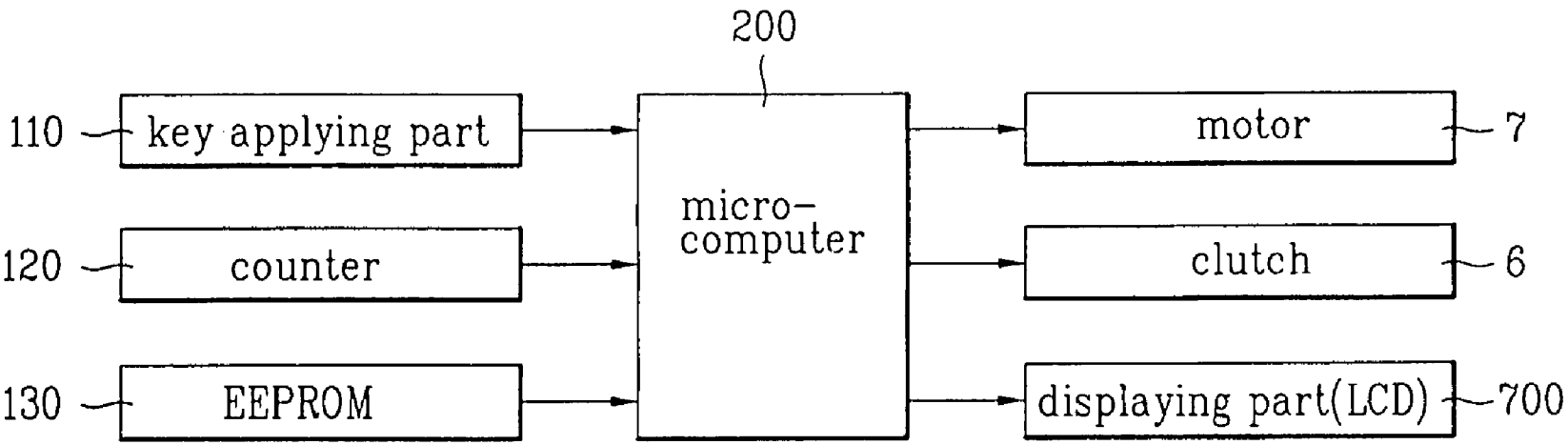
FIG. 10 illustrates a block diagram of a device for detecting malfunction of a clutch in accordance with a second preferred embodiment of the present invention.
Figure 11:
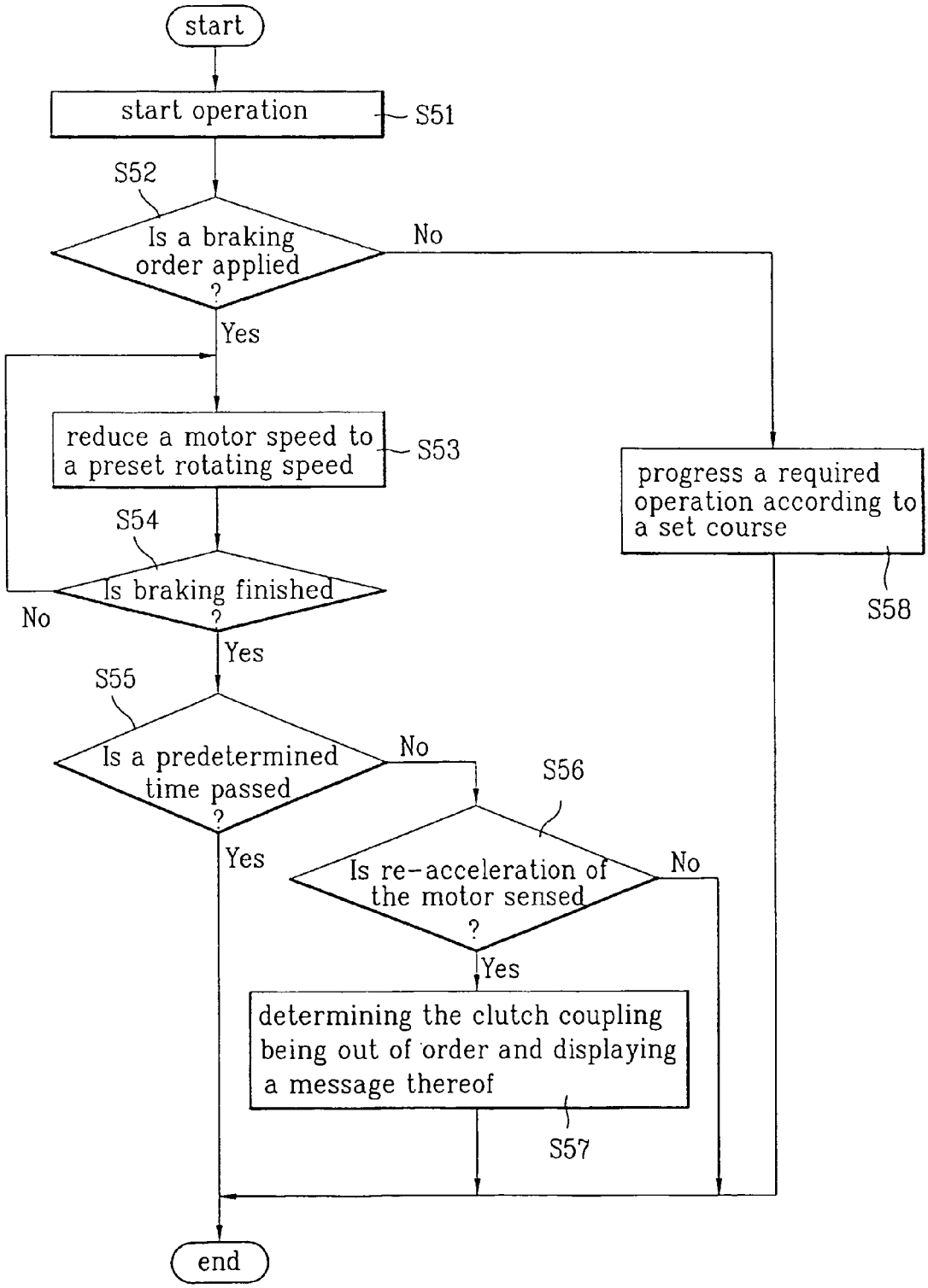
FIG. 11 illustrates a flow chart showing the steps of a method for detecting malfunction of a clutch in accordance with a second preferred embodiment of the present invention.

FIG. 10 illustrates a block diagram of a device for detecting malfunction of a clutch in accordance with a second preferred embodiment of the present invention, and FIG. 11 illustrates a flow chart showing the steps of a method for detecting malfunction of a clutch in accordance with a second preferred embodiment of the present invention.

Referring to FIG. 10, the method for detecting malfunction of a clutch in a washing machine includes a key applying part 110 for applying an order of a user, a microcomputer 200 for providing a control signal for the order of the user applied through the key applying part 100, a motor 7 and a clutch 6 for being driven in response to the control signal from the microcomputer 200, a speed sensing part 120 for sensing a rotating speed of the motor 7, an EEPROM 130 for storing program on operation and functions of the washing machine, and a display part 700 for displaying a message to the user in response to the control signal from the microcomputer 200.

In the device for detecting malfunction of a clutch in accordance with a second preferred embodiment of the present invention, when the user applies an operational order to the key applying part 10, the microcomputer 200 senses the order, and provides the control signal to various loads, such as the motor 7 and the clutch 6, for operating the washing machine.

During operation of the washing machine, if the user applies a braking order to the key applying part 1594 10, the microcomputer 200 senses the braking order, and provides the control signal to the motor 7, so as to reduce a rotating speed of the motor 7 to a preset minimum.

The microcomputer 200, determining that braking of the motor 7 is finished when the rotating speed of the motor 7 is reduced to the preset minimum, determines re-acceleration of the motor 7 within a preset time period from the determination that braking of the motor 7 is finished. Because there may be an occurrence of a case when the inner tub 2*b* (see FIG. 1) keeps rotating even if the motor 7 is braked due to out of order of the clutch 6, resulting in the re-acceleration of the motor 7. Therefore, if the motor 7 is re-accelerated to a particular speed within a preset time period, determining that the clutch 6 is out of order, the occurrence of out of order of the clutch 6 is displayed on the display part 700.

The method for detecting malfunction of a clutch in a washing machine in accordance with a second preferred embodiment of the present invention will be described.

Referring to FIG. 11, when the user applies washing machine operation order 110 of washing, rinsing, or spinning to the key applying part 100, the microcomputer 200 provides a control order, to start an operation of the user's order (S51).

During the operation of the user's order, the microcomputer 200 determines if the user applies a braking order (S52).

As a result of the determination in the step S52, if it is determined that application of the braking order is made, the microcomputer 200 reduces the rotating speed of the motor 7 to a preset minimum rotating speed (S53). Then, the microcomputer 200 determines if braking of the motor 7 is finished (S54).

As a result of the determination in the step S54, if it is determined that braking of the motor 7 is finished, the microcomputer 200 determines if a preset time period is passed (S55).

Then, as a result of the determination in the step S55, if it is determined that the preset time period is not passed, the microcomputer 200 determines if a re-acceleration of the motor 7 is detected (S56).

As a result of the determination in the step S56, if it is determined that the re-acceleration of the motor 7 is detected before pass of the preset time period, the microcomputer 200, determining that the clutch 6 is out of order, displays a clutch error message on the display part 700 (S57). In this instance, a clutch repair requesting message may be displayed, together with the clutch error message.

In the meantime, as a result of the determination in the step S52, if it is determined that no braking order is applied, an operation according to the users set course is continued (S58).

Thus, in the device and method for detecting malfunction of a clutch in a washing machine in accordance with a second preferred embodiment of the, present invention, when the user applies a braking order during operation, though braking is finished as a rotating speed is reduced to a preset minimum, if the clutch is not out of order, re-acceleration of the motor 7 within a preset time period from finishing the braking is detected at a speed sensing part 120, if the clutch 6 is broken or out of order.

If the re-acceleration of the motor 7 is detected, the microcomputer 200, determining that the clutch 6 is broken or out of order, displays an occurrence of out of order, of the clutch 6 on the display part 700, for the user to take a quick action with reference to the display.

Third Embodiment

Figure 12:
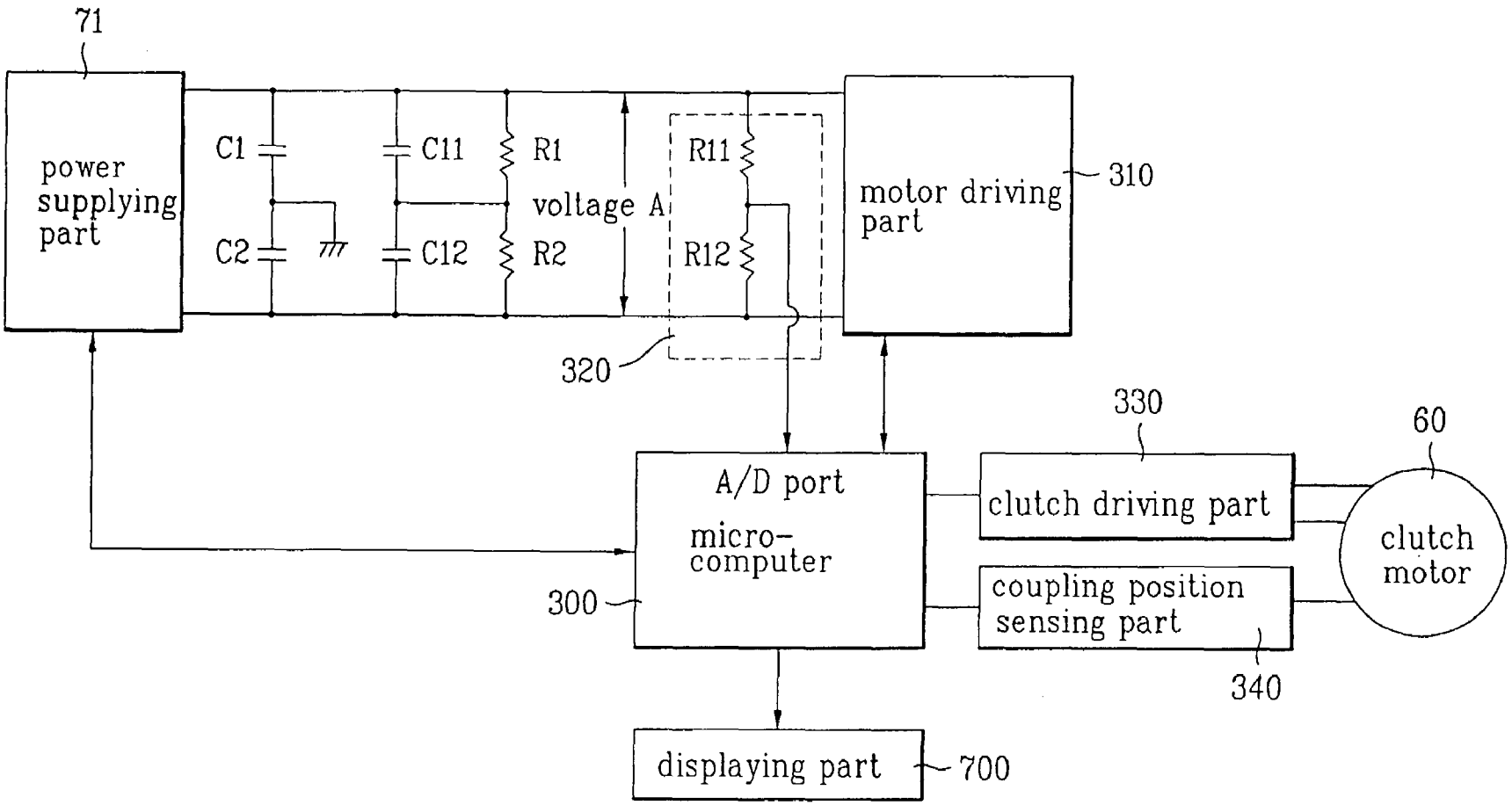
FIG. 12 illustrates a block diagram of a device for detecting malfunction of a clutch in accordance with a third preferred embodiment of the present invention.

FIG. 12 illustrates a block diagram of a device for detecting malfunction of a clutch in accordance with a third preferred embodiment of the present invention, referring to which the device for detecting malfunction of a clutch in accordance with a third preferred embodiment of the present invention will be described.

Referring to FIG. 12, the device for detecting malfunction of a clutch includes a power supplying part 71, a motor driving part 310 for receiving a voltage from the power supplying part 71, and driving the motor 7, a clutch driving part 330 for driving a clutch motor 6 to control a position of a coupling 15 (see FIGS. 2A and 2B) of the clutch 6, a coupling position sensing part 340 for sensing the position of the coupling 15, a voltage sensing part 320 connected to an input terminal of the motor driving part 310 for sensing a voltage from the power supplying part 71 to the motor driving part 310, a microcomputer 300 for controlling the motor driving part 310 and the clutch driving part 330 so as to operate the motor 7 and the clutch 6, and understanding as a clutch malfunction if the voltage sensed through the voltage sensing part 320 is higher than a preset voltage, and a display part 700 for displaying a clutch malfunction message in response to a control signal from the microcomputer 300.

Figure 13:
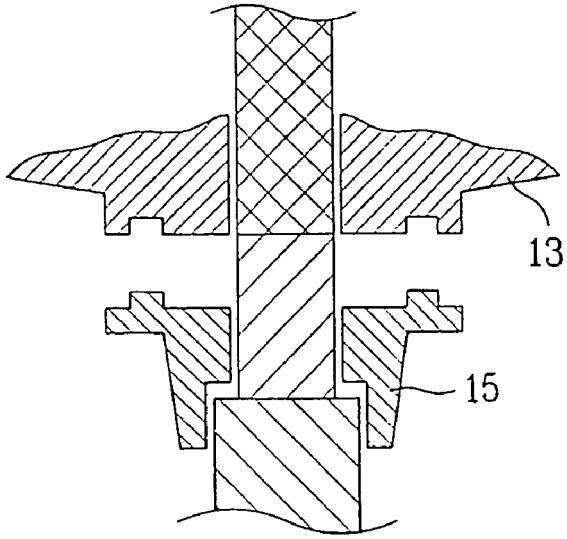
FIG. 13 illustrates clutch coupling positions for an impeller rotating type nd a tub rotating type.
Figure 13:
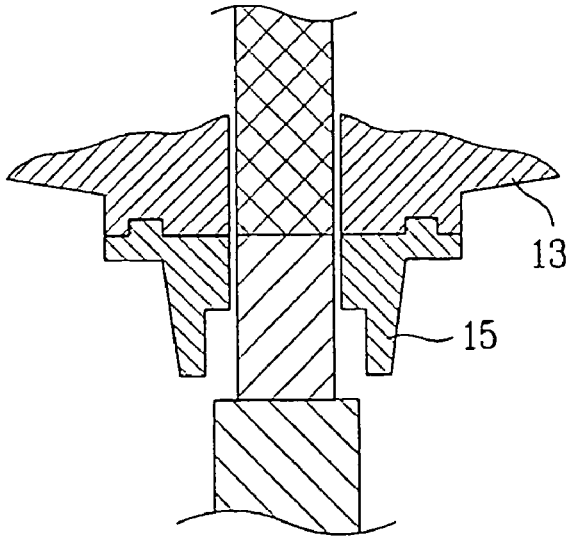

In the present invention, the microcomputer 300 senses the voltage to the motor driving part 310 through the voltage sensing part 320 when the washing machine is driven in a tub rotating mode. In this instance, as shown in FIG. 13B, in the tub rotating mode, the coupling 15 is moved up, to engage the coupling 15 with the outer tub 13 connected to the washing tub 2*b*, for transmitting a rotation power from the motor 7 both to the pulsator 3 and the washing tub 2*b*.

The voltage sensing part 320 includes first and second resistors R11 and R12 connected in a series, with a connection terminal between the first and second resistors R1 and R12 connected to an A/D input port of the microcomputer 300.

The microcomputer 300 receives a voltage from the voltage sensing part 320 through the A/D input port, and understands that the clutching operation is normal in the tub rotating mode if the received voltage is lower than a preset voltage, and, opposite to this, understands that a malfunction is caused by clutching coupling breakage if the received voltage is higher than the preset voltage.

In the tub rotating mode, in which the clutch coupling 15 is engaged with the outer tub 13 to transmit the rotating power from the motor 7 both to the pulsator and the washing tub, if the clutch coupling 15 is broken or out of a regular position, causing to fail a regular engagement of the clutch coupling 15 and the outer tub 13, a voltage higher than a regular case is occurred on opposite terminals of the motor driving part 330.

If a voltage irregularly higher than a regular case is sensed. i.e., if a malfunction is occurred by the breakage of the clutch coupling 15, the microcomputer 300 provides a control signal to the display part 700 to display an error message.

A method for detecting malfunction of a clutch in a washing machine in accordance with a third preferred embodiment of the present invention will be described.

Figure 14:
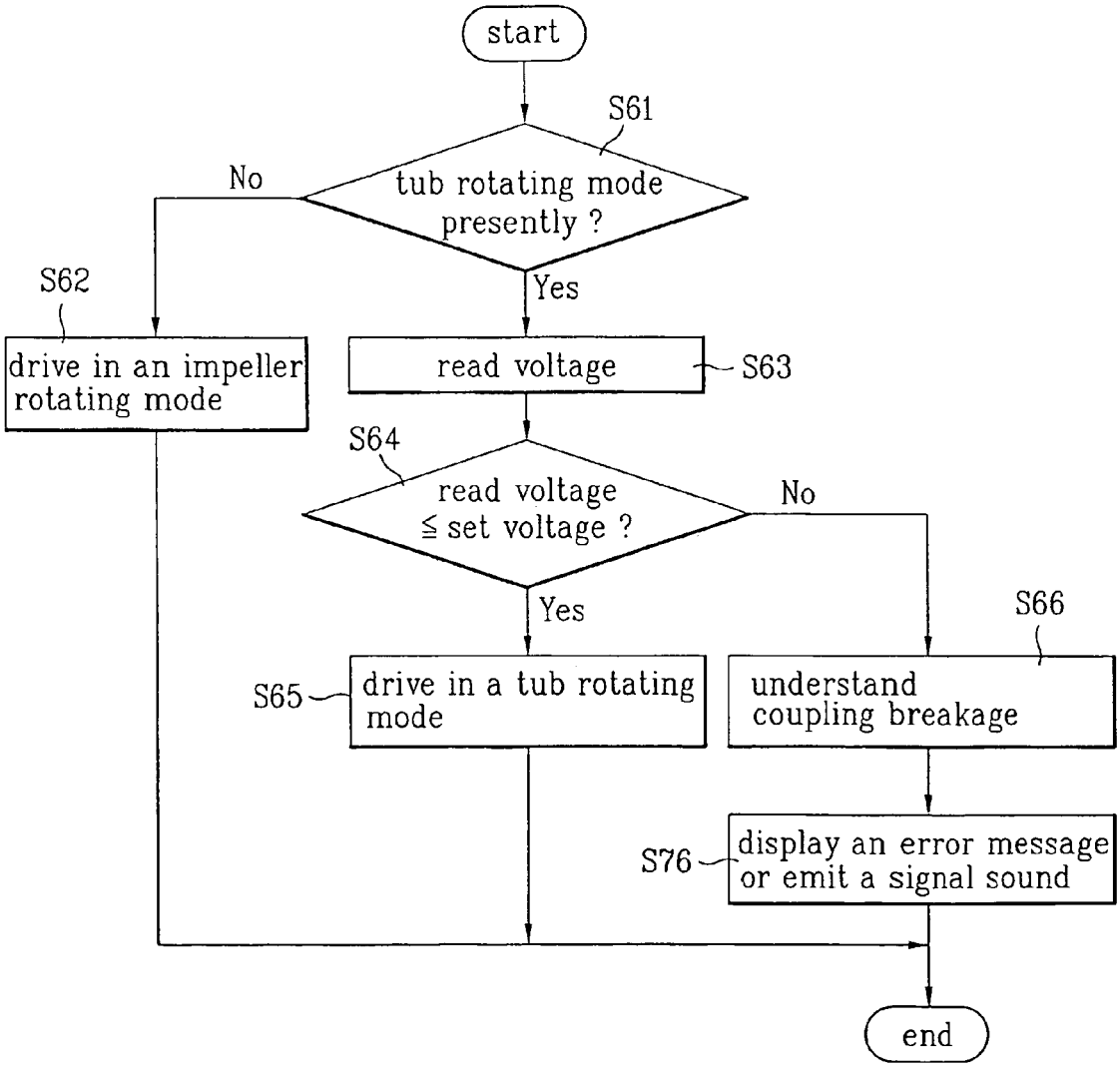
FIG. 14 illustrates a flow chart showing the steps of a method for detecting malfunction of a clutch in accordance with a third preferred embodiment of the present invention.

Referring to FIG. 14, the microcomputer 300 determines if the present operation is in a tub rotating mode (S61).

As a result of the determination in the step S61, if it is determined that if the present operation is not in a tub rotating mode, the microcomputer 300 puts the clutch motor 60 into operation, to separate the clutch coupling 15 from the outer tub 13, and operates the washing machine in an impeller rotating mode (S62). As shown in FIG. 13A, in the impeller rotating mode, the clutch coupling 15 and the outer tub 13 are separated for transmission of the motor 7 rotating power only to the pulsator 3.

Opposite to this, as a result of the determination in the step S61, if it is determined that the present operation is in the tub rotating mode, the voltage sensing part 320 senses a DC voltage at opposite terminals of the motor driving part 330 (S63).

Then, the microcomputer 300 receives the voltage from the voltage sensing part 320 through the A/D input port, and determines a level of the voltage of being lower than a level of a preset voltage (S64).

As a result of the determination in the step S64, if it is determined that the voltage is lower than the preset voltage, the microcomputer 300 continues the tub rotating mode (S65).

Opposite to this, as a result of the determination in the step S64, if it is determined that the voltage is higher than the preset voltage, the microcomputer 300 understands that the clutch coupling 15 is out of order or broken (66), and displays an error message on the display part 700, or emits a signal sound (S67).

Thus, the present invention can display an error message on a malfunction caused by breakage of clutch coupling 15 when a voltage on opposite input terminals of the motor driving part 310 high irregularly when the washing machine is in a tub rotating mode.

INDUSTRIAL APPLICABILITY

As has been described, the device and method for detecting malfunction of a clutch in a washing machine can prevent malfunction and breakage of a clutch by determining out of order of the clutch, and informing a result of the determination to a user, and hazard to the user can be reduced as irregular operation of the washing tub or the spinning tub caused by the clutch malfunction or breakage can be prevented.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for detecting malfunction of a clutch in a washing machine, the clutch including a coupling for selective transmission of a power from a motor either to a washing shaft or a spinning shaft, a clutch motor for driving the coupling, and a cam fitted to be rotatable with the clutch motor for providing a switching signal in response to the rotation, the method comprising the steps of:

(a) putting the clutch motor into operation for rotating the cam;

(b) determining if the cam provides a switching signal;

(c) repeating a process in which the clutch motor is stopped for a second set time period and operated again if the cam fails to provide the switching signal for a first set time period; and (d) displaying an error message if the cam fails to provide the error message while the process is repeated more than a set number of times.

2. The method as claimed in claim 1, further comprising the step of rotating the motor for a number of times alternately in left and right directions before putting the clutch motor into operation.

3. The method as claimed in claim 2, wherein the step of rotating the motor includes the step of rotating the motor at an angle smaller than a rotation angle of the motor in washing or rinsing.

4. The method as claimed in claim 1, further comprising the step of driving the clutch motor until a number of pulses of a voltage applied to the clutch motor reaches to a number greater than preset number of pulses in a case the cam provides a switching signal within the first set time period.

5. The method as claimed in claim 1, further comprising the steps of:

counting the number of repeated times of the process in which the clutch motor is stopped for the second set time period and operated again, and comparing a counted number of repeated times to the set number of times.

6. A method for detecting malfunction of a clutch in a washing machine, the clutch including a coupling for transmission of a power from a motor to a washing shaft or a spinning shaft, a clutch motor for providing a power to the coupling, a switch for controlling the coupling, and a cam fitted to be rotatable with the clutch motor for controlling the switch in response to the rotation, the method comprising the steps of:

(a) putting the clutch motor into operation for rotating the cam;

(b) determining if the switch is switched or not;

(c) repeating a process in which the clutch motor is stopped for a second set time period and operated again if the switch is not switched for a first set time period, and counting a number of repeated times of the process;

(d) displaying an error message if the switch is not switched while the process is repeated more than a set number of times.

7. The method as claimed in claim 6, further comprising the step of rotating the motor for a number of times alternately in left and right directions before putting the clutch motor into operation.

8. The method as claimed in claim 7, wherein the step of rotating the motor includes the step of rotating the motor at an angle smaller than a rotation angle of the motor in washing or rinsing.

9. The method as claimed in claim 6, further comprising the step of driving the clutch motor until a number of pulses of a voltage applied to the clutch motor reaches to a number greater than preset number of pulses in a case the switch is switched within the first set time period.

10. The method as claimed in claim 6, wherein the step of determining if the switch is switched or not includes the step of switching on of the switch in washing or rinsing, and switching off of the switch in spinning.

11. The method as claimed in claim 6, further comprising the step of comparing a counted number of repeated times to the set number of times.

12. A device for detecting malfunction of a clutch in a washing machine comprising:

the clutch including;

a coupling for selective transmission of a power from a motor either to a washing shaft or a spinning shaft, a clutch motor for driving the coupling, and a cam fitted to be rotatable with the clutch motor for providing a switching signal in response to the rotation;

a power supplying part for supplying a voltage to the clutch motor;

a pulse counting part for counting a number of pulses of a voltage supplied to the clutch motor from the power supplying part; and a microcomputer for repeating a process in which the clutch motor is stopped for a second set time period and operated again if the cam fails to provide a switching signal for a first set time period, and determines that the clutch is in malfunction if the failure of providing the switching signal lasts while the process is repeated equal to or more than a set times.

13. The device as claimed in claim 12, wherein the microcomputer drives the clutch motor until a number of pulses counted at the pulse counting part reaches to a preset number of pulses in a case the cam provides the switching signal within the first set time period.

14. The device as claimed in claim 12, wherein the microcomputer counts a number of repeated times of a process in which the clutch motor is stopped for a second set time period and operated again, and compares the number of repeated times to the set times.

15. The device as claimed in claim 12, wherein the microcomputer rotates the motor for a number of times alternately in left and right directions before putting the clutch motor into operation.

16. The device as claimed in claim 12, wherein the microcomputer rotates the motor for a number of times alternately in left and right directions before stopping the clutch motor.

17. The device as claimed in claim 12, further comprising a displaying part for informing malfunction of the clutch under the control of the microcomputer.

18. A device for detecting malfunction of a clutch in a washing machine comprising:

the clutch including;

a coupling for transmission of a power from a motor to a washing shaft or a spinning shaft, a clutch motor for providing a power to the coupling, a switch for controlling the coupling, and a cam fitted to be rotatable with the clutch motor for turning on/off the switch in response to the rotation;

a power supplying part for supplying a voltage to the motor and the clutch motor;

a pulse counting part for counting a number of pulses of a voltage supplied to the clutch motor from the power supplying part; and a microcomputer for repeating a process in which the clutch motor is stopped for a second set time period and operated again if the switch in not switched for a first set time period from a time the clutch motor is put into operation, and informs to a user that the clutch is in malfunction if the switch is not switched while the process is repeated equal to or more than a set times.

19. The device as claimed in claim 18, wherein the microcomputer drives the clutch motor until a number of pulses counted at the pulse counting part reaches to a preset number of pulses in a case the switch is switched within the first set time period.

20. The device as claimed in claim 18, wherein the microcomputer counts a number of repeated times of a process in which the clutch motor is stopped for a second set time period and operated again, and compares the number of repeated times to the set times.

21. The device as claimed in claim 18, wherein the cam turns on the switch in washing or rinsing, and turns off the switch in spinning.

* * * * *